US008933979B2

(12) United States Patent
Seki

(10) Patent No.: US 8,933,979 B2
(45) Date of Patent: Jan. 13, 2015

(54) ELECTROPHOTOGRAPHIC-TYPE IMAGE FORMING APPARATUS

(75) Inventor: Yuichi Seki, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 157 days.

(21) Appl. No.: 13/293,430

(22) Filed: Nov. 10, 2011

(65) Prior Publication Data

US 2012/0120177 A1 May 17, 2012

(30) Foreign Application Priority Data

Nov. 17, 2010 (JP) ..... 2010-257300
Oct. 27, 2011 (JP) ..... 2011-236481

(51) Int. Cl.

| | |
|---|---|
| ***B41J 2/385*** | (2006.01) |
| ***B41J 2/40*** | (2006.01) |
| ***B41J 2/405*** | (2006.01) |
| ***B41J 2/435*** | (2006.01) |
| ***B41J 2/47*** | (2006.01) |

(52) U.S. Cl.
CPC ..... *B41J 2/471* (2013.01)
USPC ..... 347/236; 347/133; 347/143; 347/144; 347/246

(58) Field of Classification Search
USPC ..... 347/133, 143, 144, 236, 246
See application file for complete search history.

(56) References Cited

U.S. PATENT DOCUMENTS

| | | | | |
|---|---|---|---|---|
| 6,198,497 | B1 * | 3/2001 | Luque | 347/247 |
| 7,352,786 | B2 | 4/2008 | Ikeda | |
| 7,529,282 | B2 | 5/2009 | Ikeda | |
| 2002/0122308 | A1 | 9/2002 | Ikeda | |
| 2003/0035451 | A1 * | 2/2003 | Ishida et al. | 372/38.02 |
| 2006/0133435 | A1 * | 6/2006 | Ikeda | 372/38.02 |
| 2007/0091164 | A1 * | 4/2007 | Jodra et al. | 347/247 |
| 2008/0285604 | A1 * | 11/2008 | Kawamoto | 372/25 |

FOREIGN PATENT DOCUMENTS

JP 2008-98657 A 4/2008

* cited by examiner

*Primary Examiner* — Justin Seo
*Assistant Examiner* — Kendrick Liu
(74) *Attorney, Agent, or Firm* — Fitzpatrick, Cella, Harper & Scinto

(57) ABSTRACT

An image forming apparatus comprises a light source, a photosensitive member and a control unit. The light source turns on in response to a driving current supplied based on image data. An electrostatic latent image is formed on the photosensitive member by exposing the photosensitive member to a light beam output from the light source turned on. The control unit controls the value of the driving current supplied to the light source in accordance with a driving state of the light source so that the value of the driving current supplied to the light source differs and changes with the passage of time in accordance with the driving state of the light source prior to the driving current being supplied to the light source.

13 Claims, 18 Drawing Sheets

ELECTROPHOTOGRAPHIC-TYPE IMAGE FORMING APPARATUS

BACKGROUND OF THE INVENTION

1. Field of the Invention

The present invention relates to electrophotographic-type image forming apparatuses.

2. Description of the Related Art

Electrophotographic-type image forming apparatuses form static images upon the surface of a photosensitive member by irradiating the photosensitive member with a laser beam (a light beam) emitted from a laser light source. At that time, the laser light source is driven based on an on/off signal (a pulse width modulated signal; called a "PWM signal" hereinafter) in accordance with image data, and therefore the laser light source is either in a turned-on state (an on state) or a turned-off state (an off state). Generally speaking, the current driving scheme and the voltage driving scheme exist as methods for driving a laser light source. The current driving scheme is a driving scheme that controls a current so that the current applied to the laser light source is constant. Although the current driving scheme is advantageous in that relationships between driving currents and emitted light intensities can be determined uniquely, and control is therefore easy, the light emitting response characteristics of the laser light source drop as the resistance value of an internal resistor provided in the laser light source increases. On the other hand, the voltage driving scheme controls a voltage so that the voltage applied to the laser light source is constant. Although the voltage driving scheme exhibits superior light emitting response characteristics, a voltage source is necessary for controlling the light amounts of the individual laser beams of a surface emitting laser, which is likely to lead to an increase in the scale of the circuit. Thus far, close-to-ideal driving control has been realized by exploiting the merits of both the voltage driving scheme and the current driving scheme and switching between the driving schemes based on the on/off signal. An invention in which the voltage driving scheme is used during the rise time or fall time of an on signal in a PWM signal and the current driving scheme is used in periods following the rise time or fall time of the on signal has been proposed (Japanese Patent Laid-Open No. 2008-098657).

It is desirable for the light emitting response characteristics of a laser light source, or in other words, the amount of time required for the light amount of the laser beam to rise to a predetermined value (that is, the rise time), to always be constant relative to the on/off signal that drives the laser light source. The reason is that if the light emitting response characteristics are not constant, the shapes of the dots will also not be constant. However, realistically speaking, the temperature conditions of a laser light source differ depending on the amount of time the laser beam is turned on, the amount of time the laser beam is turned off, the emitted light intensity of the laser, and so on, and as a result, the light emitting response characteristics of the laser light source (that is, the rise time) are not constant. For example, the longer the laser light source is turned off, the more the light emitting response characteristics of the laser light source will drop when the laser light source is turned on thereafter. With a method in which a control system, which controls a laser light source that emits a laser beam, monitors the terminal voltage of the laser light source and corrects the driving amount of the laser light source, the light emitting response characteristics depend on the response characteristics of the control system. In other words, a slow response speed in the control system will lead to a longer rise time for the light beam. In the case where the repeat cycle for turning the laser light source on/off in accordance with the PWM signal is extremely short, such as several tens of ns, the conditions required of the control system in terms of response speed become fairly unrealistic.

SUMMARY OF THE INVENTION

Accordingly, it is a feature of the present invention to ameliorate a drop in the light emitting response characteristics of a laser light source that depend upon a turned-on time/turned-off time determined based on image data, and stabilize the shapes of dots more than has been possible thus far.

The present invention provides an image forming apparatus comprising: a light source that turns on in response to a driving current supplied based on image data; a photosensitive member on which an electrostatic latent image is formed by exposing the photosensitive member to a light beam output from the light source turned on; and a control unit that controls the value of the driving current supplied to the light source in accordance with a driving state of the light source so that the value of the driving current supplied to the light source differs and changes with the passage of time in accordance with the driving state of the light source prior to the driving current being supplied to the light source.

There is a tendency for shapes in the rising area of the light amount in a light beam to depart from a target shape as the amount of time for which the light source is turned off, as determined by image data, increases (that is, as the amount of time the light source is turned on decreases). Note that "shapes in the rising area" refers to temporal changes in the light amount immediately after the light source has been turned on. On the other hand, there is a tendency for shapes in the rising area of the light amount to approach the target shape as the amount of time for which the light source is turned on, as determined by image data, increases (that is, as the amount of time the light source is turned off decreases). Accordingly, the size of a driving current applied to the light source in the rise time of the light amount in the light beam is controlled in accordance with the lengths of the times for which the light source was turned on and off immediately prior thereto. As a result, a drop in the light emitting response characteristics of a laser light source that depend upon a turned-on time/turned-off time determined based on image data are ameliorated, and the shapes of dots can be stabilized more than has been possible thus far.

Further features of the present invention will become apparent from the following description of exemplary embodiments (with reference to the attached drawings).

DESCRIPTION OF THE EMBODIMENTS

First Embodiment

Figure 1:
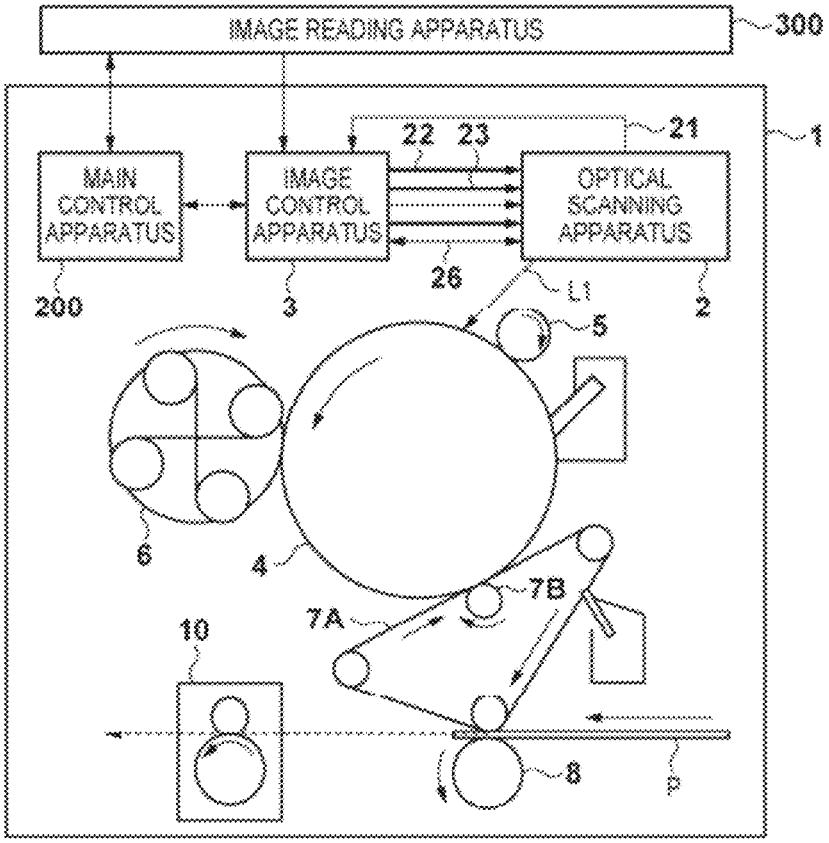
FIG. 1 is a block diagram illustrating an image forming apparatus.

An image forming apparatus 1 illustrated in FIG. 1 is an apparatus that forms images read by an image reading apparatus 300, images sent from a host computer, and the like on a transfer material P. The image reading apparatus 300 reads an image from an original in accordance with a reading control signal from a main control apparatus 200, and outputs an image signal to an image control apparatus 3. The main control apparatus 200 controls the image control apparatus 3 by outputting the image control signal to the image control apparatus 3. The image control apparatus 3 generates image data (a PWM signal 22) from the image signal and outputs the image data to an optical scanning apparatus 2. Furthermore, the image control apparatus 3 outputs, to the optical scanning apparatus 2, a laser control signal group 23 for controlling a laser light source, a motor control signal 26 for a motor that drives a polygon mirror, and so on. The optical scanning apparatus 2 sends a beam detection signal (a BD signal 21), mentioned later, to the image control apparatus 3.

A photosensitive drum 4 is an image carrier on which an electrostatic latent image is formed by exposing the photosensitive drum 4 using a light beam (laser beam) emitted from the light source, and that carries a toner image formed by developing that electrostatic latent image. The surface of the photosensitive drum 4 is uniformly charged to a predetermined potential by a charging roller 5. The optical scanning apparatus 2 sequentially irradiates the photosensitive drum 4 with a laser beam L1 in accordance with image data of the respective colors yellow (Y), magenta (M), cyan (C), and black (Bk). This forms an electrostatic latent image. Thereafter, the electrostatic latent image is developed by a developing unit 6, and a toner image is formed upon the photosensitive drum 4 as a result. The toner image upon the photosensitive drum 4 is transferred onto an intermediate transfer belt 7A, serving as an intermediate transfer member. Furthermore, the toner image upon the intermediate transfer belt 7A is transferred onto a desired transfer material P by a transfer roller 8. This unfixed toner image that has been formed upon the transfer material P is then fixed by a fixing apparatus 10.

Figure 2:
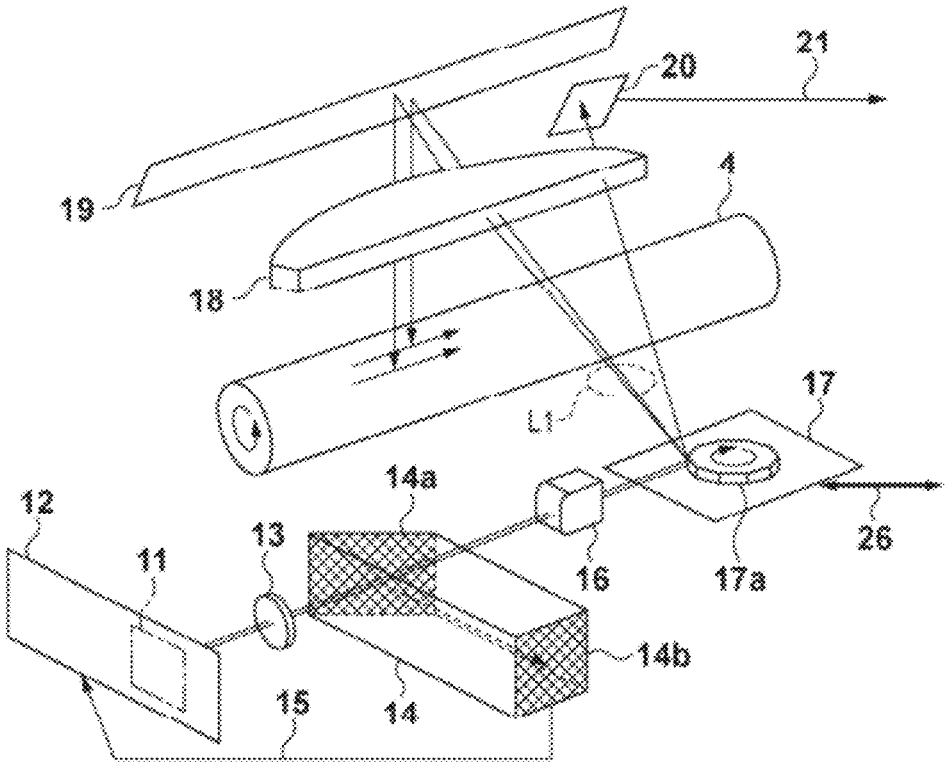
FIG. 2 is a perspective view illustrating an optical scanning apparatus.

FIG. 2 is a selected structural diagram illustrating the optical scanning apparatus 2 according to the present embodiment. A semiconductor laser 11 is an example of a light source. The semiconductor laser 11 includes one or more light-emission points that emit a laser beam. The PWM signal, which is a drive signal, is supplied to the semiconductor laser 11. The PWM signal is set to a pulsewidth (duty ratio) that corresponds to one pixel in accordance with a pixel darkness value based on the image data (pixel data). The turned-off time and turned-on time are determined by the darknesses of the pixels in the image data. A laser beam is emitted from the semiconductor laser 11 for an amount of time based on the set pulsewidth. Because the PWM signal is a signal for modulating the pulsewidth in accordance with the pixel data, the turned-on time of the semiconductor laser is longer the wider the pulsewidth of the PWM signal is. The longer the turned-on time is, the greater the exposure area for each unit of surface area is; and because the surface area of the electrostatic latent image also increases as a result, the amount of toner per unit of surface area that attaches to the photosensitive drum 4 increases as well. Accordingly, the longer the turned-on time is, the darker the toner image that is formed will become. Conversely, the shorter the turned-on time is, the lower the exposure area for each unit of surface area is; and because the surface area of the electrostatic latent image also decreases as a result, the amount of toner per unit of surface area that attaches to the photosensitive drum 4 decreases as well. Accordingly, the shorter the turned-on time is, the lighter the toner image that is formed will become.

In this manner, the semiconductor laser 11 repeatedly alternates between turning on and off in accordance with the PWM signal generated based on the image data. An LED or a different type of light-emitting element may be employed instead of the semiconductor laser 11. A photodetection unit (called a "PD unit 14" hereinafter) includes a half mirror 14*a* and a photodetector (called a "PD 14*b*" hereinafter) provided on a beam output surface. The half mirror 14*a* has a property of splitting a laser beam that has been emitted from the semiconductor laser 11 and that has passed through a collimate lens 13 into a laser beam that passes through and a laser beam that is reflected. In other words, the half mirror 14*a* functions so as to reflect part of the laser beam that has passed through the collimate lens 13 and lead that beam to the PD 14*b*. The PD 14*b* receives the laser beam reflected by the half mirror 14*a* and outputs a photodetection signal 15 in accordance with the received light amount. A laser driving apparatus 12 functions as a light source driving unit that drives the light source by correcting the drive signal based on a correction signal generated by a correction signal generation unit, described later.

As shown in FIG. 2, the laser driving apparatus 12 is provided within the optical scanning apparatus 2, and controls the driving current based on a result of the detection performed by the photodetection signal 15 so that the laser beam emitted by the semiconductor laser 11 has a predetermined light amount. The laser beam L1 traverses the collimate lens 13 and a cylindrical lens 16, and reaches a polygon mirror 17*a*. The polygon mirror 17*a* is rotated at a constant angular velocity by a scanner motor unit 17 including a scanner motor. The laser beam that has reached the polygon mirror 17*a* is deflected by the polygon mirror 17*a*, and is converted by a f-θ lens 18 into scanning light that scans the photosensitive drum 4 in the rotation direction and right angle direction thereof at equal speeds. Note that a beam detector 20 ("BD" hereinafter) is disposed within the scanning optical path of the laser beam L1 in a position that corresponds to a non-image region. The BD 20 outputs the BD signal 21, which determines a reference position for the image region. The BD signal 21 is used to determine the timing of writes in the main scanning direction (that is, the direction in which the laser beam moves upon the rotating photosensitive drum 4). The laser beam L1 that scans the image region passes through the f-θ lens 18 and exposes the surface of the photosensitive drum 4 via a reflecting mirror 19. An electrostatic latent image based on the image data is thus formed upon the photosensitive drum 4 as a result of the photosensitive drum 4 being exposed by the laser beam L1.

Figure 4A:
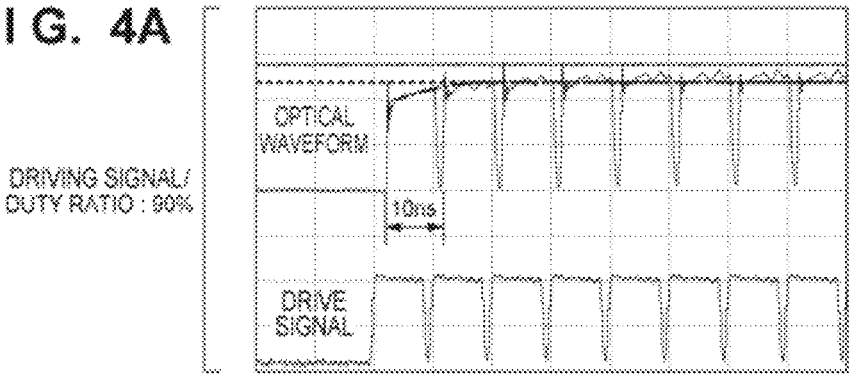
FIGS. 4A through 4C are charts illustrating the output waveforms (optical waveforms) of light beams whose drive signal duty ratios are 90%, 50%, and 20%, respectively.
Figure 4B:
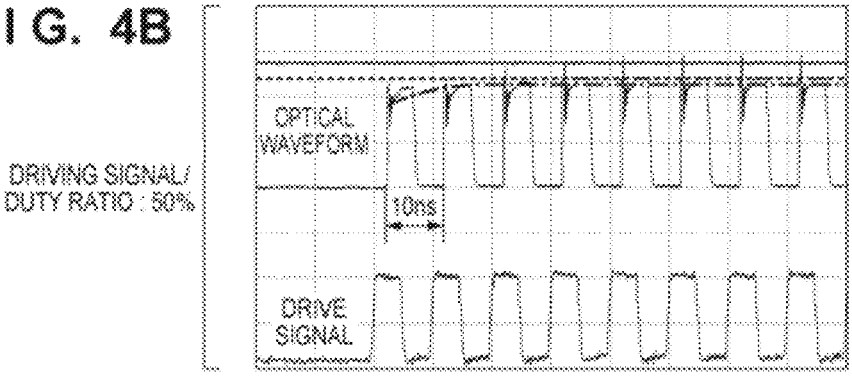
Figure 4C:
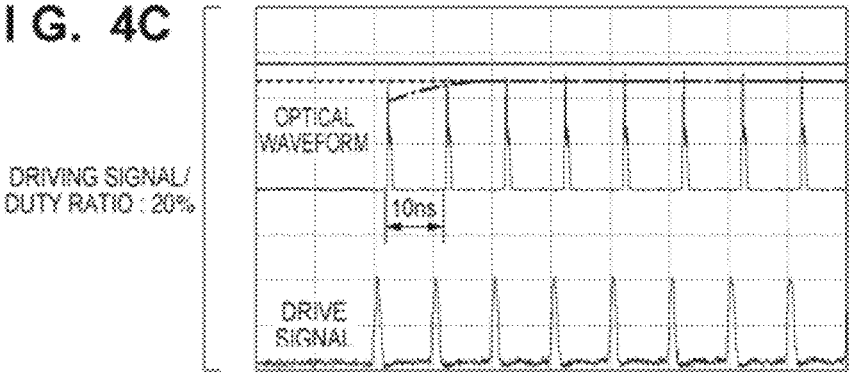

Next, issues regarding the image forming apparatus according to the present embodiment will be described. FIGS. 4A, 4B, and 4C illustrate output waveforms of laser beams (that is, light amount waveforms) occurring when PWM signals having duty ratios of 90%, 50%, and 20%, respectively are continuously generated and driving currents based thereon are supplied to the semiconductor laser 11. The wave lines in FIGS. 4A, 4B, and 4C indicate target values. The rising characteristics of an optical waveform deteriorate sharply when a time in which the semiconductor laser 11 is not driven continues for more than several μs. Furthermore, according to FIGS. 4A, 4B, and 4C, it can be seen that the rising characteristics of the optical waveform improve with each repetition of light emission by the semiconductor laser 11, and that the light amount further approaches the target value. This phenomenon is caused by the temperature characteristics of the semiconductor laser 11.

In this manner, the rising characteristics of the light amount waveform fluctuate based on the driving state of the semiconductor laser 11 prior to supplying the driving current to the semiconductor laser 11. Such a fluctuation in rising characteristics leads to non-uniformity in the positions where pixels are formed, the darknesses of the formed pixels, and so on.

In response to this issue, the image forming apparatus according to the present embodiment adjusts the value of the driving current supplied to the semiconductor laser 11 in accordance with the turned-on time and the turned-off time of the semiconductor laser 11 prior to the supply of the driving current in order to correct the light emitting response characteristics (rising characteristics) of the semiconductor laser. Hereinafter, a configuration in which a correction amount for generating a correction signal for correcting the rising characteristics is set and a driving current corrected based on the correction amount is supplied to the semiconductor laser 11 will be described as an example.

Figure 3:
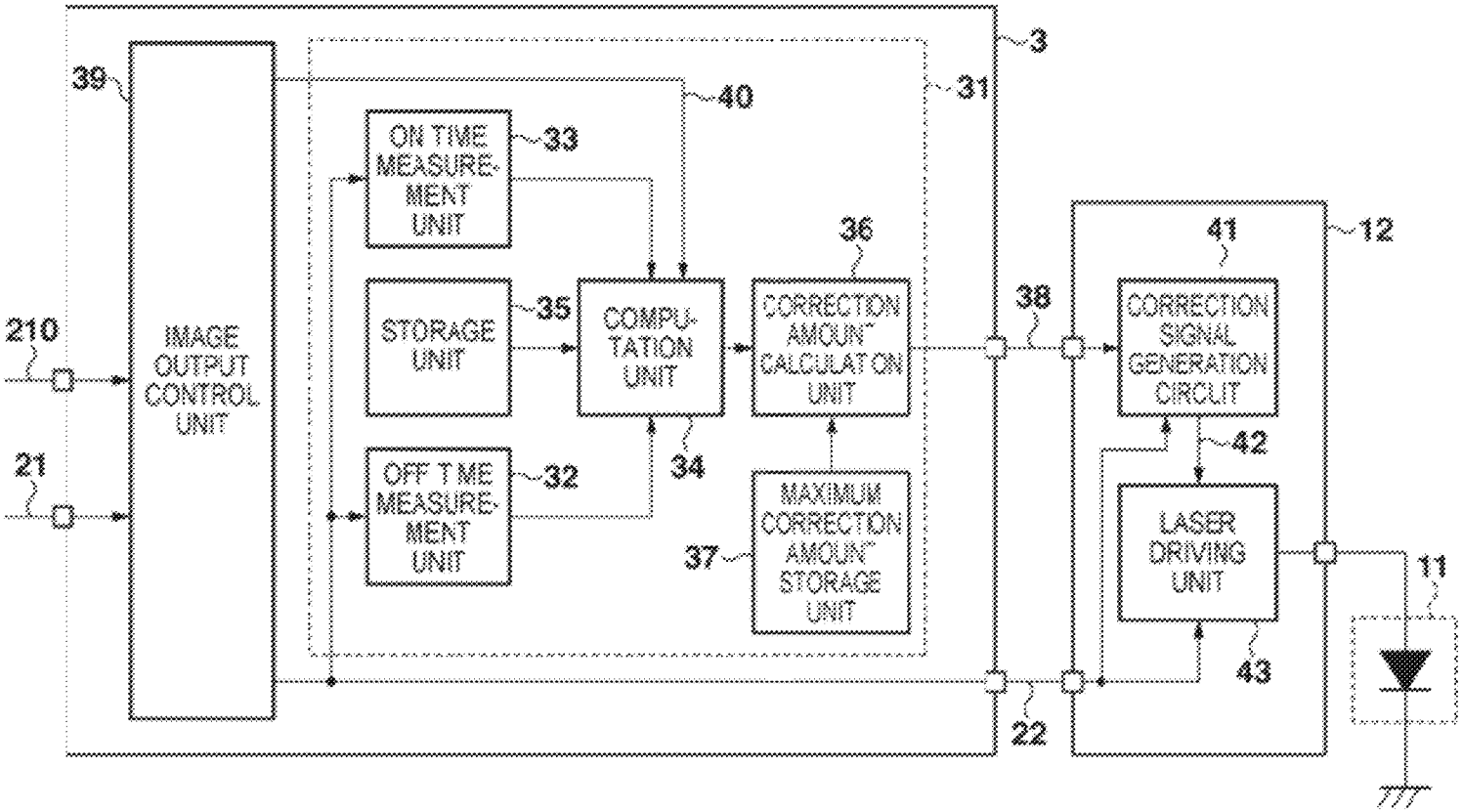
FIG. 3 is a block diagram illustrating a correction amount generation unit.

FIG. 3 is a block diagram illustrating the image control apparatus 3. An image output control unit 39 receives an image control signal 210 from the main control apparatus 200. The BD signal 21 is input into the image output control unit 39. If the image control signal 210 is a print start command, the image output control unit 39 generates the PWM signal 22 based on the image data and outputs the PWM signal 22 to the laser driving apparatus 12 in accordance with the BD signal 21. A current is supplied to the laser driving apparatus 12 from a current source (not shown), and a driving current is supplied to the semiconductor laser 11 in accordance with the supply of a high-level PWM signal. When a print start command has been input, the image output control unit 39 outputs, to a computation unit 34, a computation control signal 40 instructing operations to start.

A correction amount generation unit 31, the laser driving apparatus 12, and so on control the value of the driving current supplied to the semiconductor laser 11 during the rise time of the light amount of the light beam in accordance with the lengths of the turned-on time and turned-off time (that is, the driving state of the semiconductor laser 11) prior to the driving current being supplied to the semiconductor laser 11 based on a certain high-level PWM signal. The correction amount generation unit 31 determines a correction amount for correcting the value of the driving current in accordance with the lengths of the turned-on time and the turned-off time of the semiconductor laser 11. For example, the correction amount generation unit 31 increases the correction amount as the turned-off time of the semiconductor laser 11 that has been turned off in response to the PWM signal lengthens, reduces the correction amount as the turned-on time of the semiconductor laser 11 that has been turned on in response to the PWM signal lengthens, and so on.

Here, a configuration for computing the turned-off time and the turned-on time of the semiconductor laser 11 will be described. The PWM signal is input into an on time measurement unit 33 from the image output control unit 39, and the on time measurement unit 33 measures, based on the PWM signal, the turned-on time occurring prior to the supply of the driving current based on the high-level PWM signal (that is, the time where the PWM signal is at high-level; called the "on time" hereinafter). Likewise, the PWM signal is input into an off time measurement unit 32 from the image output control unit 39, and the off time measurement unit 32 measures, based on the PWM signal, the turned-off time occurring prior to the supply of the driving current based on the low-level PWM signal (that is, the time where the PWM signal is at low-level; called the "off time" hereinafter). Data regarding the result of measuring the on time is input from the on time measurement unit 33 into the computation unit 34, and data regarding the result of measuring the off time is input from the off time measurement unit 32 into the computation unit 34. The on time measurement unit 33 and the off time measurement unit 32 may compute the on time and the off time, respectively, based on the image data for generating the PWM signal.

The computation unit 34 (a "computation unit") computes, as a computation value, the percentage of off time or the percentage of on time in a certain predetermined amount of time that is prior to the supply of the driving current based on a certain high-level PWM signal, the computation being carried out based on the input data. Note that the computation unit 34 may be configured so as to compute the cumulative ratio between off time and on time in a certain predetermined amount of time. Alternatively, the computation unit 34 may be configured so as to compute the cumulative ratio between off time and on time starting from the input of the PWM signal. Hereinafter, descriptions will proceed assuming a configuration in which the computation unit 34 computes the cumulative ratio between off time and on time in a certain predetermined amount of time (that is, the ratio of on time to off time or the ratio of off time to on time). Note that the computation value computed by the computation unit 34 indicates the driving state of the semiconductor laser 11 prior to the supply of a driving current based on the high-level PWM signal.

A correction amount calculation unit 36 generates a correction amount 38 in accordance with the computation value output from the computation unit 34 or a maximum correction amount (described in detail later) stored in a maximum correction amount storage unit 37. In other words, the correction amount 38 is determined based on the on time or the off time of the semiconductor laser 11 as calculated by the computation unit 34, or is instead set to the maximum correction amount.

A laser driving unit 43 is provided in the laser driving apparatus 12 along with a correction signal generation circuit 41. The correction signal generation circuit 41 is a signal generation unit that generates a correction signal 42 that corresponds to the correction amount 38 generated by the correction amount generation unit 31. The laser driving unit 43 corrects the value of the driving current supplied to the semiconductor laser 11 based on the correction signal 42 that has been generated by the correction signal generation circuit 41 in accordance with the correction amount 38, and outputs the driving current of the corrected value to the semiconductor laser 11. Note that the correction amount generation unit 31 may be provided in and integrated with the laser driving apparatus 12.

Figure 5A:
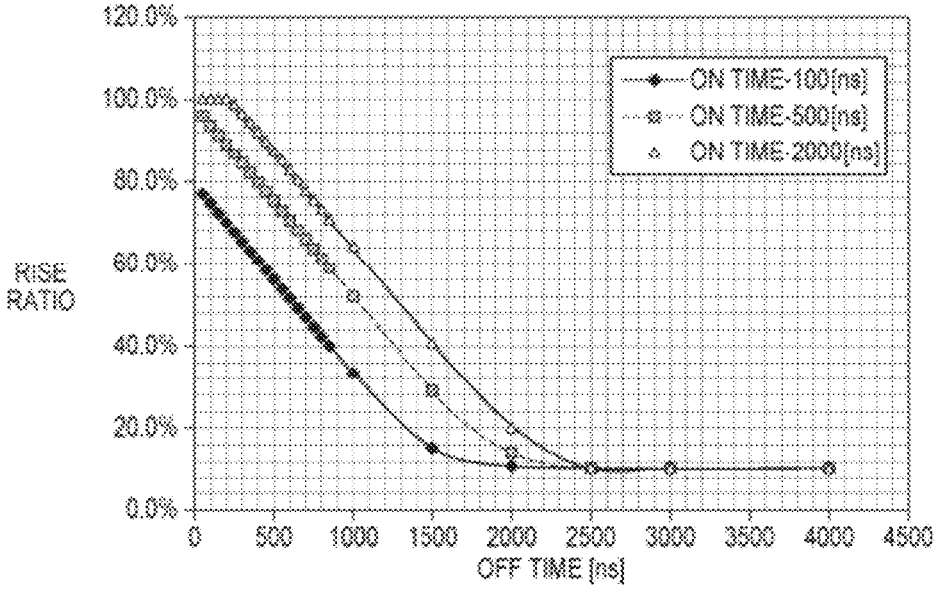
FIGS. 5A and 5B are diagrams illustrating a relationship between the time for which a semiconductor laser is turned off and a rise ratio of a light beam.
Figure 5B:
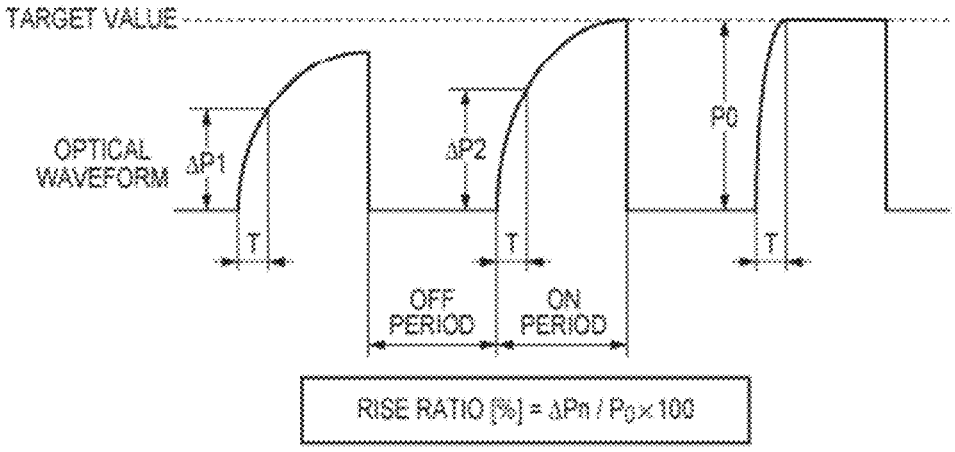
Figure 6:
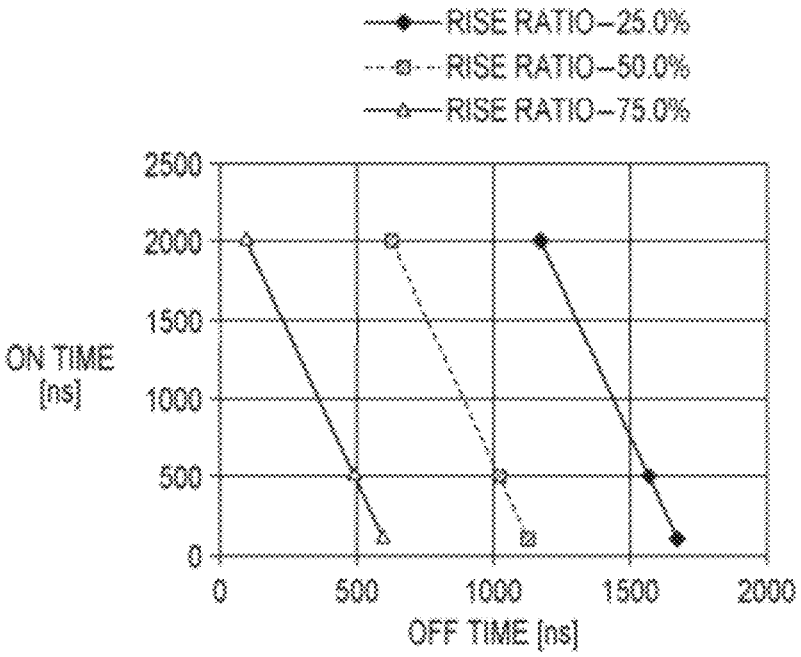
FIG. 6 is a graph illustrating a relationship between a turned-off time and a turned-on time within a specified rise ratio.

As illustrated in FIGS. 5 and 6, a deterioration in the rising characteristics of a laser beam is influenced by the off time or the on time of the semiconductor laser 11 prior to the timing at which a certain PWM signal changes from low level to high level (that is, the turn-on timing). Accordingly, in order to correct the deterioration in the rising characteristics of the laser beam, the off time or the on time of the semiconductor laser 11 prior to a certain turn-on timing can be measured, and a correction amount for correcting the driving current can be found based on the results of the measurement. For example, the correction amount 38 is found as described hereinafter based on the relationship between a continuous on time τon and a continuous off time τoff determined by the PWM signal 22.

Figure 7B:
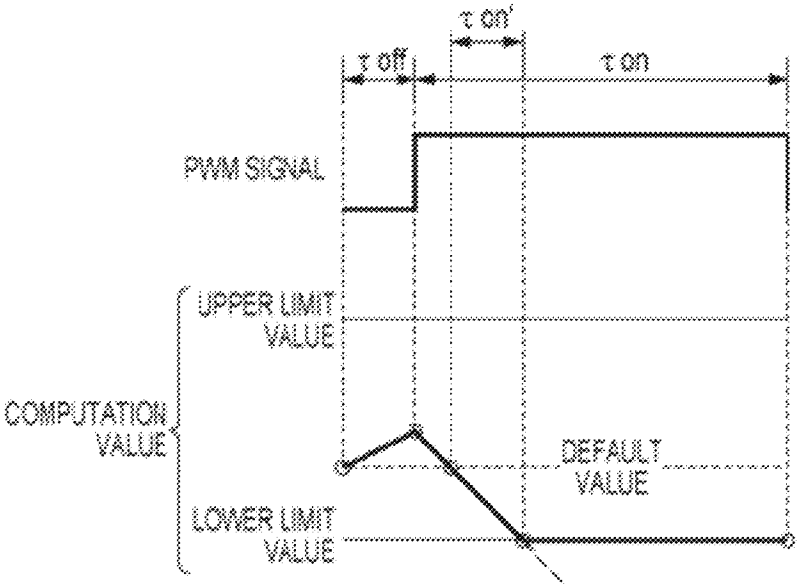
FIGS. 7A and 7B are diagrams illustrating a correction amount calculation method.
Figure 7A:
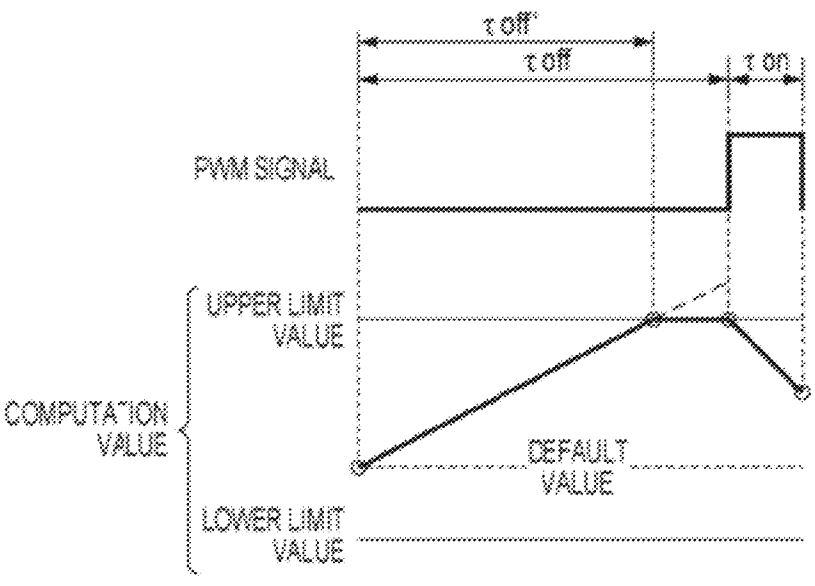

FIGS. 7A and 7B are diagrams illustrating a correction amount calculation method for a case in which the on time and the off time of the PWM signal 22 differ. The correction amount calculation unit 36 computes the correction amount 38 based on the computation value computed by the computation unit 34. Furthermore, a storage unit 35 used for setting upper and lower limits of the correction amount 38 is provided in the image forming apparatus according to the present embodiment; the computation unit 34 receives data regarding an upper limit value and a lower limit value from the storage unit 35, and computes the correction amount 38 based on that data so that the correction amount 38 takes on a value that is between the upper limit value and a lower limit value.

The reason why an upper limit value and a lower limit value are necessary for the correction amount 38 will be described next. A relationship between the ratio of the turned-on state in which the semiconductor laser 11 is turned on (that is, a ratio between the on time and the off time) and the rise ratio of the light beam is indicated in FIGS. 5A and 5B. The "rise ratio" refers to a degree to which a target value P0 for the emitted light intensity of the light beam is attained in a pre-set target time T of the rise. The rise ratio is defined by, for example, the following equation.

$$\text{rise ratio}=\Delta Pn/P0\times 100[\%]$$

Here, n is an index indicating what number pulse the pulse is. The rise ratio refers to the rate of deviation from a target value, and the greater the rise ratio value, the closer the value is to the target value.

In FIG. 5A, the horizontal axis represents the off time prior to the supply of the driving current to the semiconductor laser 11, whereas the vertical axis represents the rise ratio. Furthermore, on times (100 ns, 500 ns, 2,000 ns) indicate on times occurring immediately before the off times indicated in the horizontal axis. In other words, it can be seen from FIG. 5A that the rise ratio is 40% (indicated by the point X in FIG. 5A) when the driving current is supplied after the semiconductor laser 11 is turned on for 2,000 ns and then turned off for 1,500 ns.

Based on FIG. 5A, it can be seen that when the off time prior to the supply of the driving current is long, the rise ratio of the semiconductor laser 11 drops, and the light amount waveform within the target time T does not rise to the target value P0 even if the driving current is then supplied. In addition, it can be seen that if the ratio between the on time and the off time prior to the driving current being supplied to the semiconductor laser 11 is high, the rise ratio drops. Furthermore, based on FIG. 5A, it can be seen that there is a region in which the rise ratio drops as the turned-off time prior to the supply of the driving current to the semiconductor laser 11 increases (that is, a region in which the rise time increases; called a "proportional region" hereinafter) and a region in which the rise ratio does not change even if the turned-off time increases (that is, a region in which the rise time is constant; called a "saturated region" hereinafter).

In the proportional region, the off time and the on time in a given rise ratio have a relationship such as that illustrated in FIG. 6. Accordingly, the correction amount 38 for the rising characteristics can be found based on the relationship between the off time and the on time. Although the off time and on time are in an essentially proportional relationship in FIG. 6, there are also cases where the relationship can be expressed as a multiple higher-order function, depending on the characteristics of the semiconductor laser 11.

On the other hand, in the saturated region, when the off time becomes greater than or equal to a predetermined amount of time (in FIG. 5A, in the vicinity of 2,000 ns to 2,500 ns), the rise ratio is saturated at approximately 10%. Accordingly, the correction amount 38 is fixed at the upper limit value when the rise ratio is saturated. However, according to FIG. 5A, the rise ratio is 100% when the on time is 2,000 ns and the off time is less than or equal to 300 ns. Accordingly, the correction is unnecessary in such a case, and thus the value of the driving current is not corrected based on the correction amount 38.

The computation unit 34 sets the upper limit value and the lower limit value of the correction amount as follows. FIGS. 7A and 7B are timing charts illustrating a correspondence relationship between the PWM signal (or image data) supplied to the semiconductor laser 11 and the upper limit value and the lower limit value of the ratio between the off time and the on time. FIG. 7A illustrates an example in the case where the correction amount 38 is set to the upper limit value, whereas FIG. 7B illustrates a case where the correction amount 38 is set to the lower limit value.

Figure 9:
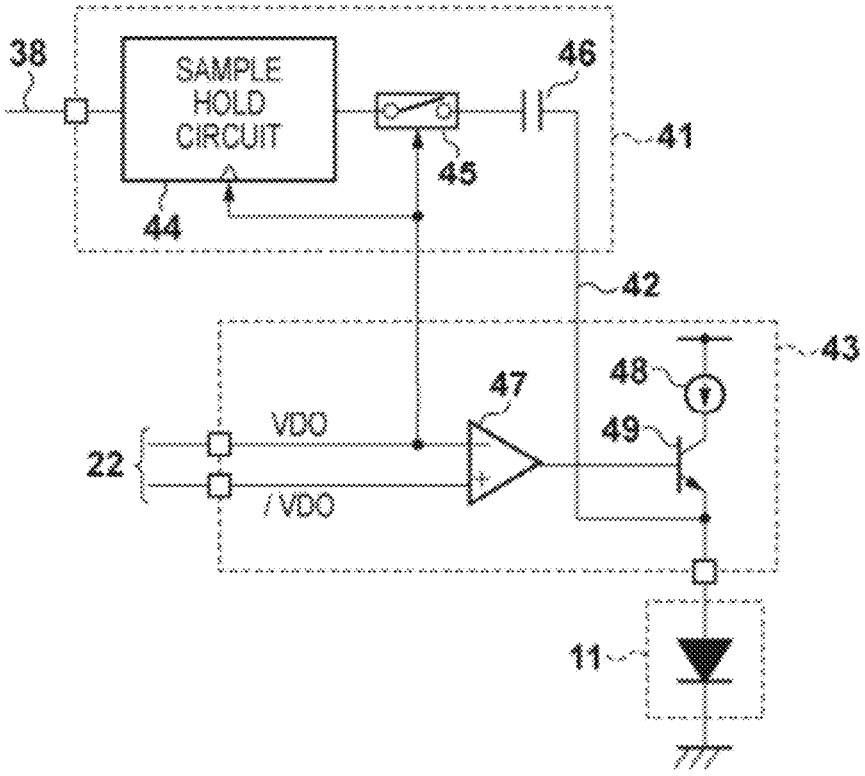
FIG. 9 is a block diagram illustrating a laser driving apparatus.

First, a case in which the percentage of the on time relative to the off time reaches an upper limit and the correction amount 38 is set to the upper limit value (this corresponds to the maximum correction amount illustrated in FIG. 9 and described later) based thereon will be described using FIG. 7A. FIG. 7A illustrates a situation in which the off time of the semiconductor laser 11 continues for τoff (ns), after which the semiconductor laser 11 turns on for τon (ns). It is assumed that in FIG. 7A, the percentage of on time relative to off time is set to a default value in the starting time of the off time. In FIG. 7A, the ratio of on time relative to off time drops due to the off time continuing, and therefore the computation unit 34 gradually increases the ratio of on time relative to off time from the default value as time passes. When the off time reaches τoff' (ns), the ratio of on time relative to off time computed by the computation unit 34 reaches the upper limit value. The data regarding the upper limit value is input to the computation unit 34 from the storage unit 35, and the computation unit 34 sets (fixes) the ratio of on time relative to off time to the upper limit value in accordance with the ratio of on time relative to off time reaching the upper limit value. Then, when τoff (ns) has passed after the starting time of the off time, a driving current is supplied to the semiconductor laser 11 in accordance with the PWM signal for τon (ns). At this time, the upper limit value set by the computation unit 34 is input to the correction amount calculation unit 36, and therefore the correction amount calculation unit 36 reads out the data regarding the maximum correction amount from the maximum correction amount storage unit 37 and outputs that data to the correction signal generation circuit 41. The correction signal generation circuit 41 outputs, to the laser driving unit 43, the correction signal 42 based on the data regarding the maximum correction amount from the correction amount calculation unit 38. The laser driving unit 43 corrects the value of the driving current supplied to the semiconductor laser 11 based on the correction signal 42.

Meanwhile, to calculate the correction amount 38 for correcting the driving current when the driving current is supplied to the semiconductor laser 11 after the passage of τoff (ns), the computation unit 34 begins computing the ratio of on time relative to off time starting with the ratio of on time relative to off time following the passage of τoff (ns). In other words, the on time continues for τon (ns) following the passage of τoff (ns) from the starting time of the off time, and this period is a period in which the percentage of on time relative to off time increases. Accordingly, the computation unit 34 gradually reduces the percentage of on time relative to off time as time passes, as illustrated in FIG. 7A. Then, during the off time following τoff+τon (ns), the computation unit 34 computes the percentage of on time relative to off time at the point in time of τoff+τon (ns). The correction amount calculation unit 36 calculates the correction amount 38 in the same manner as the stated τoff (ns) in accordance with the percentage of on time relative to off time output from the computation unit 34 (that is, the computation value).

Next, a case in which the correction amount 38 is set to the lower limit value will be described using FIG. 7B. FIG. 7B illustrates a situation in which the off time of the semiconductor laser 11 continues for τoff (ns), after which the semiconductor laser 11 turns on for τon (ns). It is assumed that in FIG. 7B, the percentage of on time relative to off time is set to a default value in the starting time of the off time. In FIG. 7B, the ratio of on time relative to off time drops due to the off time continuing, and therefore the computation unit 34 gradually increases the ratio of on time relative to off time from the default value as time passes.

When the off time reaches τoff (ns), a driving current in accordance with the PWM signal is supplied to the semiconductor laser 11 for τon (ns). At this time, the ratio of on time relative to off time as computed by the computation unit 34 does not reach the lower limit value, and the computation unit 34 outputs, to the correction amount generation unit 31, the ratio of on time relative to off time computed at the point in time when τoff (ns) is passed (that is, the computation value). The correction amount calculation unit 36 calculates the correction amount 38 based on the ratio of on time relative to off time output from the computation unit 34, and outputs that correction amount 38 to the correction signal generation circuit 41.

The correction signal generation circuit 41 outputs, to the laser driving unit 43, the correction signal 42 based on the correction amount 38 output from the correction amount calculation unit 36 at the point in time when the correction amount calculation unit 36 has determined that τoff (ns) has passed. The laser driving unit 43 corrects the value of the driving current supplied to the semiconductor laser 11 based on the correction signal 42.

Meanwhile, to calculate the correction amount 38 for correcting the driving current when the driving current is supplied to the semiconductor laser 11 after the passage of τoff (ns), the computation unit 34 begins computing the ratio of on time relative to off time, which is the computation value, starting with the ratio of on time relative to off time following the passage of τoff (ns). In other words, the on time continues for τon (ns) following the passage of τoff (ns) from the start period of the off time, and this period is a period in which the percentage of on time relative to off time increases. Accordingly, the computation unit 34 gradually decreases the percentage of on time relative to off time from the upper limit value as time passes, as illustrated in FIG. 7B. After τon' (ns) has passed after the semiconductor laser 11 has been turned on, the ratio of on time relative to off time reaches the lower limit value. The data regarding the lower limit value is input into the computation unit 34 from the storage unit 35. For this reason, when the ratio of on time relative to off time reaches the lower limit value, the computation unit 34 sets (fixes) the ratio of on time relative to off time to the lower limit value without decreasing the correction amount 38 any further. In the case where the ratio of on time relative to off time is set to the lower limit value by the computation unit 34, the rise ratio is 100%, and thus it is not necessary to correct the driving current. Accordingly, in the case where the ratio of on time relative to off time has been set to the lower limit value by the computation unit 34, the correction amount calculation unit 36 sets the correction amount to "0".

Next, the correction signal generation circuit 41 and the laser driving unit 43 will be described using FIG. 9.

The correction signal generation circuit 41 is configured of a sample hold circuit 44, a switch 45, and a capacitor 46. The correction amount 38 output from the correction amount calculation unit 36 is input into the sample hold circuit 44. Of the PWM signal, a non-inverting signal VDO is input into the sample hold circuit 44, and the sample hold circuit 44 samples the correction amount 38 at the timing of the rise of the non-inverting signal VDO. The switch 45 outputs a signal when the non-inverting signal VDO of the PWM signal 22 is on, whereas the output of the switch 45 is set to GND level in other periods.

Accordingly, an electrical load based on the correction amount 38 from the sample hold circuit 44 is charged in synchronization with the rise of the non-inverting signal VDO. The sample hold circuit 44 outputs a derivative component in synchronization with the rising signal of the output signal from the switch 45. The output from the capacitor 46 is a correction signal 42 (the correction current).

The laser driving unit 43 is configured of a comparator 47, a constant current source 48, and a transistor 49. The input PWM signal 22 is output to the base terminal of the transistor 49 through the comparator 47. The constant current source 48 is connected to the collector terminal of the transistor 49. Accordingly, a driving current based on the PWM signal 22 is output to the emitter terminal of the transistor 49. This is the driving current for the semiconductor laser 11. On the other hand, the output terminal of the capacitor 46 is connected to the emitter terminal of the transistor 49. Thus the correction signal 42 is added to the driving current for the semiconductor laser 11.

Figure 8:
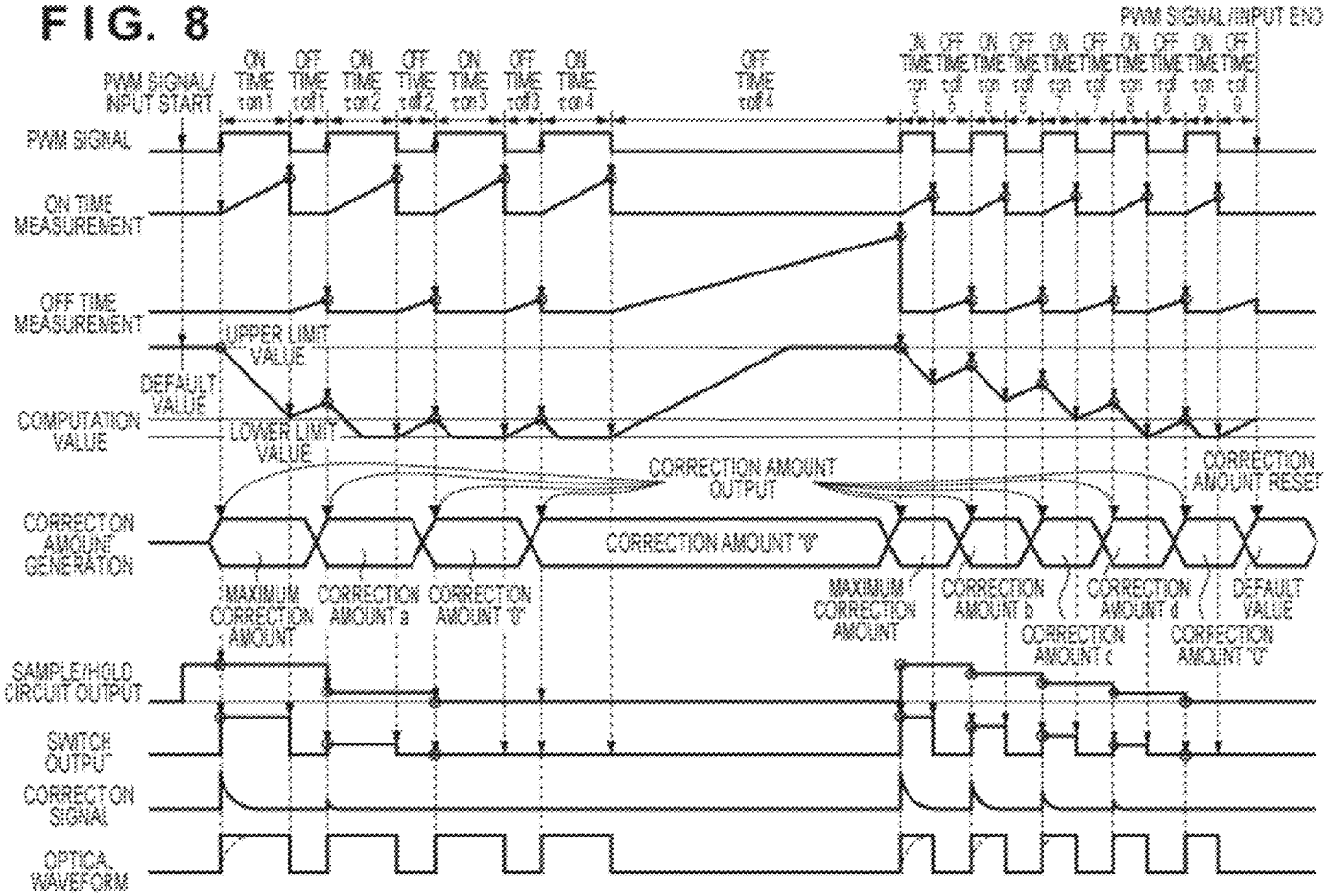
FIG. 8 is a timing chart illustrating operations performed by a correction amount generation unit.

Processing carried out by the correction amount generation unit 31 will be described using the timing chart illustrated in FIG. 8. FIG. 8 illustrates the following, starting from the top: the PWM signal 22 (image data); the on time measurement unit 33 output; the off time measurement unit 32 output; the computation unit 34 output; the correction amount calculation unit 36 output (the correction amount 38); the output of the sample hold circuit 44 shown in FIG. 9; the switch 45 output; the correction signal 42; and the optical waveform. The horizontal axis represents time.

The output of the on time measurement unit 33 takes on a higher numerical value the longer the on time extends. Likewise, the output of the off time measurement unit 32 takes on a higher numerical value the longer the off time extends. The output of the computation unit 34 (the computation value) is a result calculated based on the measured values for the on time, as measured by the on time measurement unit 33, and the off time, as measured by the off time measurement unit 32. The period when the PWM signal is at high level is a period in which the on time measured by the on time measurement unit 33 increases with time, and thus the computation value as computed by the computation unit 34 decreases; on the other hand, the period when the PWM signal is at low level is a period in which the off time measured by the off time measurement unit 32 increases with time, and thus the computation value as computed by the computation unit 34 increases.

When the input of the PWM signal 22 commences, the computation unit 34 sets the computation value to the upper limit value. Because a state in which the semiconductor laser 11 has been turned off has continued prior to the start of the input of the PWM signal 22, it is difficult for the light amount waveform to rise. For this reason, the computation unit 34 sets the computation value to the upper limit value in order to correct the driving current for turning the semiconductor laser 11 on according to the maximum correction amount. As a result, the value of the driving current is corrected based on the maximum correction amount the first time the semiconductor laser 11 is turned on following the start of the input of the PWM signal 22. The correction amount calculation unit 36 calculates the correction amount 38 based on the computation value output from the computation unit 34. In other words, the computation value is output as the correction amount 38 after the off time $\tau$off (ns) has ended. Note that the correction amount calculation unit 36 outputs the maximum correction amount stored in the maximum correction amount storage unit 37 to the correction signal generation circuit 41 as the correction amount 38 when the computation value computed by the computation unit 34 reaches the upper limit value, and outputs "0", indicating that the value of the driving current is not to be corrected, to the correction signal generation circuit 41 as the correction amount 38 when the computation value computed by the computation unit 34 reaches the lower limit value. Note also that a state in which the computation value reaches the lower limit value is a state in which the rising characteristics are favorable due to a long on time for the semiconductor laser 11 prior to the supply of a driving current based on a certain high-level PWM signal (that is, a state in which the rise ratio is 100%). Accordingly, in such a case, it is not necessary to correct the value of the driving current supplied to the semiconductor laser 11, and thus the correction amount calculation unit 36 outputs "0" to the correction signal generation circuit 41 as the correction amount 38.

Other processing may be employed as the processing by which the correction amount generation unit 31 generates a correction amount 38. For example, a ratio of on time or off time to a total amount of time may be calculated based on the total amount of time of an on signal and the total amount of time of an off signal from the start to the end of the output of the PWM signal 22, and that value may be used.

Figure 10:
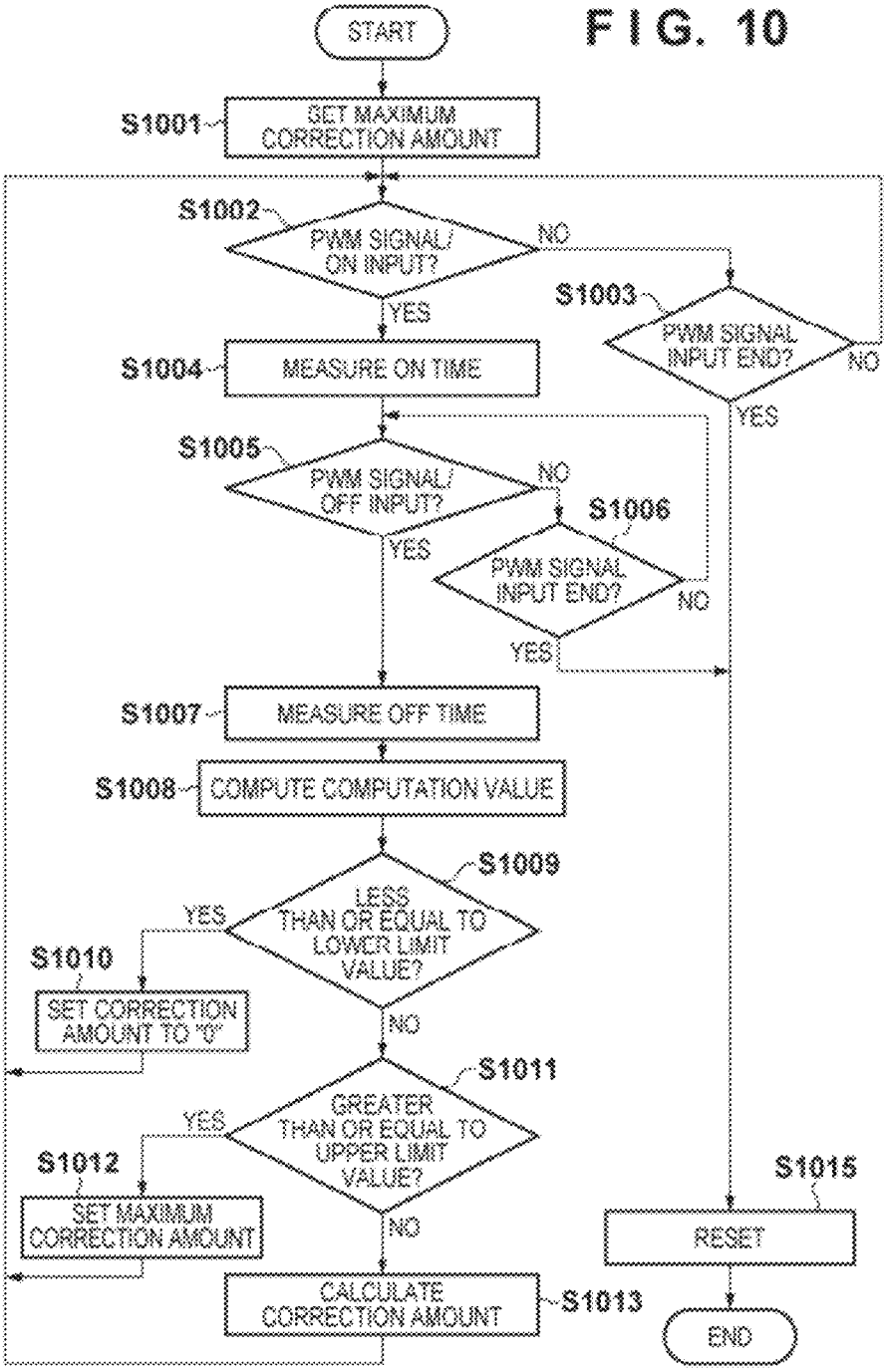
FIG. 10 is a flowchart illustrating a basic correction operation carried out by a correction amount generation unit.

FIG. 10 is a flowchart illustrating control executed by the correction amount generation unit 31.

The correction amount generation unit 31 causes the correction amount calculation unit 36 to read out the pre-set correction amount from the maximum correction amount storage unit 37 in response to the start of the input of the PWM signal, and sets the maximum correction amount in the correction signal generation circuit 41 as an initial correction amount 38 (S1001).

The correction amount generation unit 31 determines whether or not a high-level PWM signal (an on signal) has been input (S1002). The correction amount generation unit 31 advances the control to S1003 in the case where it has been determined that the on signal has not been input, and advances the control to S1004 in the case where it has been determined that the on signal has been input.

The correction amount generation unit 31 then determines whether or not the input of the PWM signal 22 from the image output control unit 39 has ended (S1003). If the input has not ended for all PWM signals 22, the correction amount generation unit 31 returns the control to S1002. If the input has ended for all PWM signals 22, the correction amount generation unit 31 resets the measurement result of the on time measurement unit 33, the measurement result of the off time measurement unit 32, the computation result of the computation unit 34, and the correction amount 38 from the correction amount calculation unit 36; the control then ends (S1015).

In the case where it has been determined in S1002 that the on signal has been input, the correction amount generation unit 31 causes the on time measurement unit 33 to measure the amount of time that the on signal continues to be input to the on time measurement unit 33 (S1004). The on time measurement unit 33 is configured of, for example, a counter, and the counter begins counting up in response to the PWM signal 22 going to high level and stops counting up in response to the PWM signal 22 going to low level.

Next, the correction amount generation unit 31 determines whether or not a low-level PWM signal (an off signal) has been input (S1005). In that case where it has been determined that an off signal has not been input, the correction amount generation unit 31 advances the control to S1006, whereas in the case where it has been determined that an off signal has been input, the correction amount generation unit 31 advances the control to S1007.

The correction amount generation unit 31 then determines whether or not the input of the PWM signal 22 from the image output control unit 39 has ended (S1006). If the input has not ended for all PWM signals 22, the correction amount generation unit 31 returns the control to S1005. If the input has ended for all PWM signals 22, the correction amount generation unit 31 advances the control to S1015.

The correction amount generation unit 31 causes the off time measurement unit 32 to measure the amount of time that the off signal of the PWM signal 22 continues to be input to the off time measurement unit 32 (S1007). The off time measurement unit 32 is configured of, for example, a counter, and the counter begins counting up in response to the PWM signal 22 going to low level and stops counting up in response to the PWM signal 22 going to high level.

The correction amount generation unit 31 causes the computation unit 34 to compute the computation value based on the measurement result from the on time measurement unit 33 (that is, the continuous on time) and the measurement result from the off time measurement unit 32 (that is, the continuous off time) (S1008).

The correction amount generation unit 31 then causes the correction amount calculation unit 36 to determine whether or not the computation value computed by the computation unit 34 is less than or equal to the lower limit value stored in the storage unit 35 (S1009). In the case where it has been determined by the correction amount calculation unit 36 that the computation value is less than or equal to the lower limit value, the correction amount generation unit 31 advances the control to S1010, whereas in the case where it has been determined by the correction amount calculation unit 36 that the computation value is greater than the lower limit value, the correction amount generation unit 31 advances the control to S1011.

In S1010, the correction amount generation unit 31 causes the correction signal generation circuit 41 to output "0" to the correction amount calculation unit 36 as the correction amount 38.

In S1011, the correction amount generation unit 31 causes the correction amount calculation unit 36 to determine whether or not the computation value computed by the computation unit 34 is greater than or equal to the upper limit value stored in the storage unit 35. In the case where it has been determined by the correction amount calculation unit 36 that the computation value is greater than or equal to the upper limit value, the correction amount calculation unit 36 advances the control to S1012, whereas in the case where it has been determined by the correction amount calculation unit 36 that the computation value is not greater than or equal to the upper limit value, the correction amount generation unit 31 advances the control to S1013.

In the case where the correction amount calculation unit 36 has determined in S1011 that the computation value is greater than or equal to the upper limit value, the correction amount generation unit 31 causes the correction amount calculation unit 36 to output the maximum correction amount read out from the maximum correction amount storage unit 37 to the correction signal generation circuit 41 as the correction amount 38 (S1012). However, in the case where the correction amount calculation unit 36 has determined in S1011 that the computation value is not greater than or equal to the upper limit value, the correction amount generation unit 31 causes the correction amount calculation unit 36 to calculate the correction amount based on the computation value, and outputs the correction amount to the correction signal generation circuit 41. The correction amount calculation unit 36 computes the correction amount by multiplying the computation value by a pre-set coefficient. The pre-set coefficient is assumed to have been determined through experimental results and simulations for calculating the characteristic values of the semiconductor laser, the correction amount, and so on. The computation unit 34 can determine this from at least one of, for example, the percentage of time the on signal is supplied to the semiconductor laser 11 relative to a certain predetermined amount of time and the percentage of time the off signal is supplied to the semiconductor laser 11 relative to a certain predetermined amount of time. Note that the correction amount calculation unit 36 is realized as, for example, an analog circuit that implements a uniquely-determined function for calculating the correction amount from the computation value computed by the computation unit 34. Alternatively, the correction amount calculation unit 36 may be configured so as to execute the aforementioned computation using a table in which computation values and correction amounts are associated with each other and stored, a memory in which a function for calculating the correction amount from the computation value is stored in advance, and so on. Note that the former is more advantageous from the standpoint of computation speed. As shown in FIG. 8, this correction amount is a correction amount that compensates for the rising characteristics of the optical waveform occurring due to the lengths of the off time, the on time, and so on. The correction signal generation circuit 41 generates and outputs a correction signal such as that shown in FIG. 8 based on the correction amount. According to FIG. 8, an insufficient rise can be compensated for by adding the correction signal to the drive signal (a driving current or a driving voltage) generated based on the PWM signal.

Second Embodiment

Fluctuations in the relationship between the emitted light intensity and the correction amount can be expected to occur over time and so on. Accordingly, the present embodiment proposes altering the correction amount 38 in accordance with the emitted light intensity of the light beam from the semiconductor laser 11 in addition to the on time and the off time of the PWM signal 22 in order to generate the correction amount 38. In other words, the correction amount calculation unit 36 is characteristic in carrying out variable control of the correction amount in accordance with the emitted light intensity of a detected light beam. Elements that have already been described will be given the same reference numerals for the sake of brevity.

Figure 11:
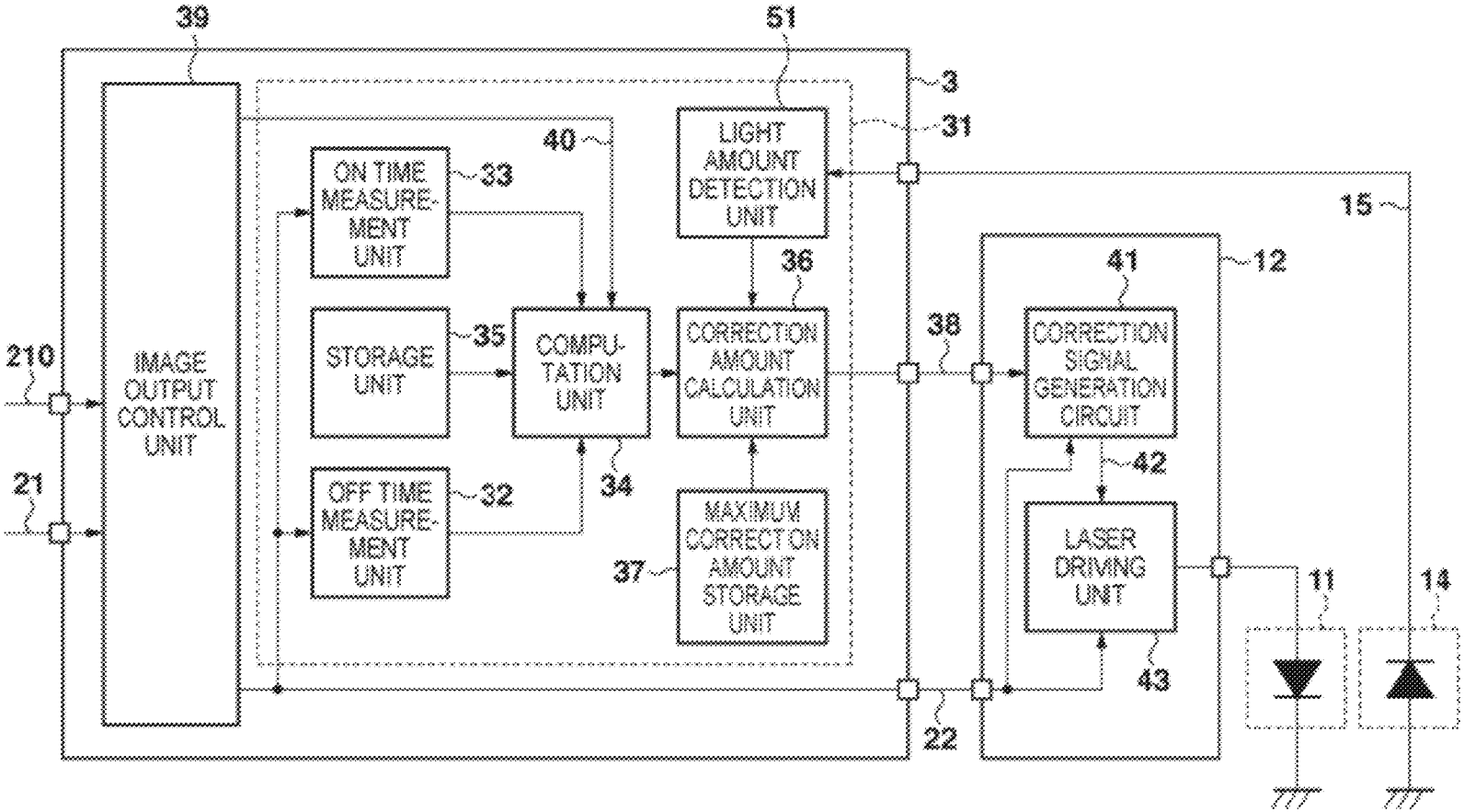
FIG. 11 is a block diagram illustrating a correction amount generation unit according to a second embodiment.
Figure 12:
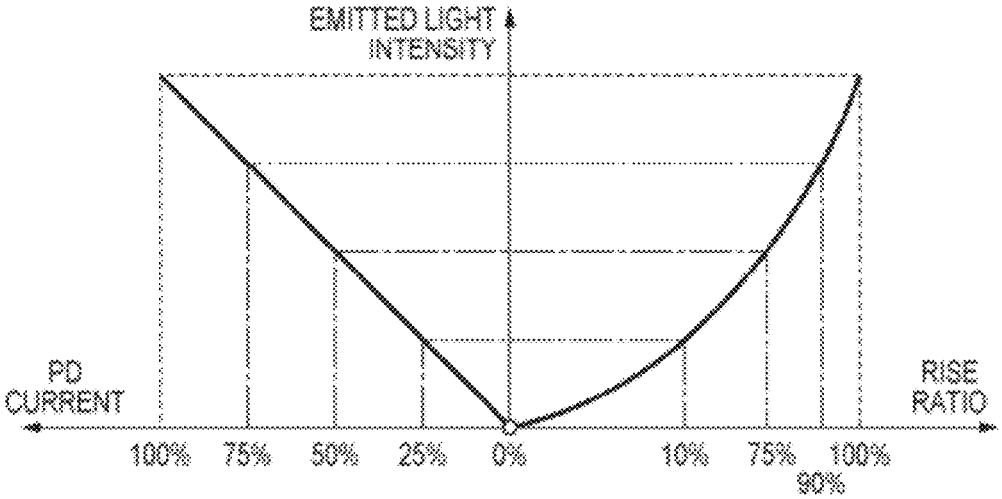
FIG. 12 is a chart illustrating a relationship between the emitted light intensity of a light beam and a rise ratio.

FIG. 11 is a block diagram illustrating a correction amount generation unit. A light amount detection unit 51 detects the emitted light intensity (received light intensity) of a light beam from the semiconductor laser 11 based on the photodetection signal 15 input from a light amount detection unit 14. The light amount detection unit 14 and the light amount detection unit 51 function as an emitted light intensity detection unit that detects the emitted light intensity of a light beam. A method for determining the correction amount 38 relative to an emitted light intensity will be described using FIG. 12. FIG. 12 illustrates a rise ratio of a light beam from the semiconductor laser 11 relative to the emitted light intensity. The left side of FIG. 12 illustrates the emitted light intensity relative to the photodetection signal 15. Using the characteristic in which the photodetection signal 15 is in proportion to the emitted light intensity of the light beam, it is possible to detect the emitted light intensity by measuring the photodetection signal 15. On the other hand, the right side of FIG. 12 illustrates a relationship between the emitted light intensity and the rise ratio. Therefore, the rise ratio of the light beam from the semiconductor laser 11 can be uniquely determined in accordance with the emitted light intensity (the photodetection signal 15).

The light amount detection unit 51 finds the rise ratio of the light beam from the semiconductor laser 11 based on the emitted light intensity of the light beam, and calculates an alteration coefficient for the correction amount 38. The light amount detection unit 51 includes, for example, a function or a table expressing relationships between photodetection signals 15 and alteration coefficients. Accordingly, the light amount detection unit 51 obtains the alteration coefficient corresponding to the photodetection signal 15 from the table or the like, and outputs that alteration coefficient to the correction amount calculation unit 36. The correction amount calculation unit 36 calculates the correction amount based on the computation value computed by the computation unit 34, and calculates a final correction amount by multiplying that correction amount by the alteration coefficient output from the light amount detection unit 51. The second embodiment is therefore useful in cases such as where the relationship between the emitted light intensity and the correction amount changes over time and so on.

Third Embodiment

The optimal correction amount can be expected to fluctuate depending on the internal temperature of the image forming apparatus. In other words, if the internal temperature is high, the degradation in the rising characteristics will not be as significant even if there is a long on time prior to the supply of a driving current based on a certain high-level PWM signal to the semiconductor laser 11. Accordingly, in a third embodiment, a temperature detection unit is provided for the purpose of using the temperature within the image forming apparatus 1 as the alteration coefficient in addition to the on time and the off time of the PWM signal 22 in order to generate the correction amount 38. Through this, variable control of the correction amount can be carried out in accordance with the detected temperature. Elements that have already been described will be given the same reference numerals for the sake of brevity.

Figure 13:
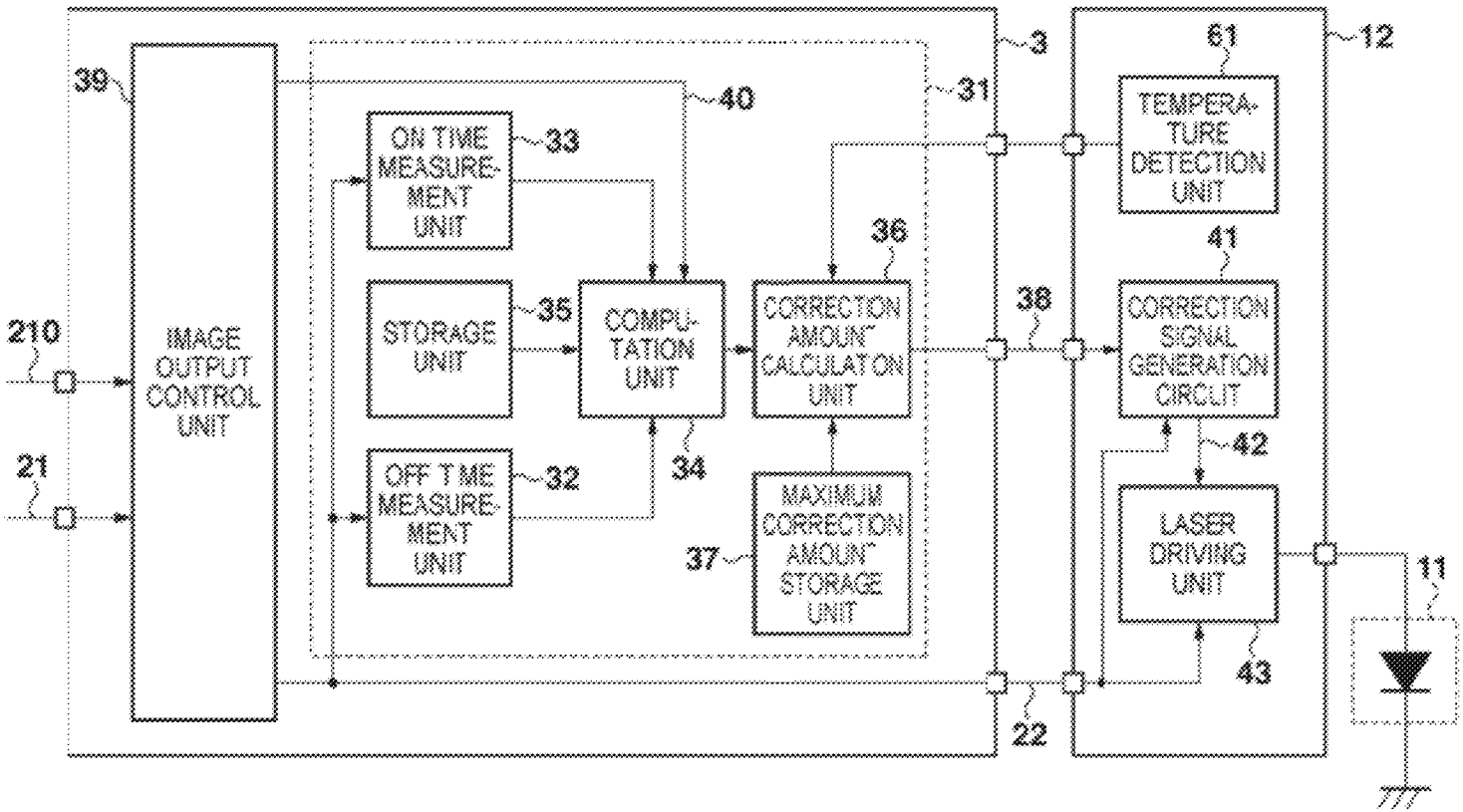
FIG. 13 is a block diagram illustrating a correction amount generation unit according to a third embodiment.
Figure 14:
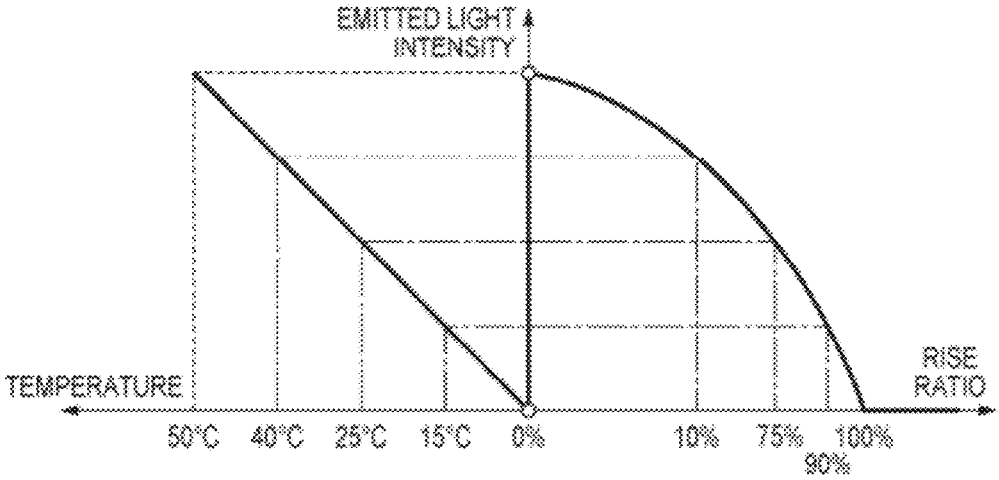
FIG. 14 is a chart illustrating a relationship between the internal temperature of an image forming apparatus and a rise ratio.

FIG. 13 is a block diagram illustrating a correction amount generation unit. A temperature detection unit 61 functions as a temperature detection unit that detects a temperature within the image forming apparatus. The temperature detection unit 61 is provided, for example, within the image forming apparatus 1 (and particularly within the laser driving apparatus 12), and detects the temperature of the semiconductor laser. A method for determining the correction amount 38 relative to the temperature will be described using FIG. 14. FIG. 14 illustrates an example of the rise ratio of the light beam from the semiconductor laser 11 relative to a measured temperature. The left side of FIG. 14 illustrates the emitted light intensity relative to the output of the temperature detection unit 61 (that is, the measured value of the temperature). On the other hand, the right side of FIG. 14 illustrates the rise ratio relative to the emitted light intensity. Therefore, the rise ratio of the light beam can be uniquely determined in accordance with the temperature of the laser driving apparatus 12.

The correction amount calculation unit 36 finds the rise ratio of the light beam based on the measured value of the temperature, and calculates the alteration coefficient for the correction amount 38 corresponding to the rise ratio that has been found. The correction amount calculation unit 36 may include, for example, a function or a table expressing relationships between temperatures and alteration coefficients. Accordingly, the correction amount calculation unit 36 obtains the alteration coefficient corresponding to the temperature from the table or the like. The correction amount calculation unit 36 calculates the correction amount based on the computation value computed by the computation unit 34, and calculates a final correction amount by multiplying that correction amount by the alteration coefficient. In this manner, the third embodiment is useful in the case where the optimal correction amount fluctuates depending on the internal temperature. Note that the second embodiment and the third embodiment may be combined. In other words, the correction amount calculation unit 36 may alter the correction amount by multiplying the correction amount, found based on the computation value computed by the computation unit 34, by the two types of alteration coefficients.

Fourth Embodiment

A fourth embodiment illustrates an example in which the mechanism described in the first through third embodiments is applied in a multi-beam type light source provided with multiple light-emitting elements. In particular, the present embodiment is characteristic in that control circuits configured as groups including one each of a correction amount determination unit, a signal generation unit, and a light source driving unit are provided one-to-one for each of multiple light-emitting units.

Figure 15:
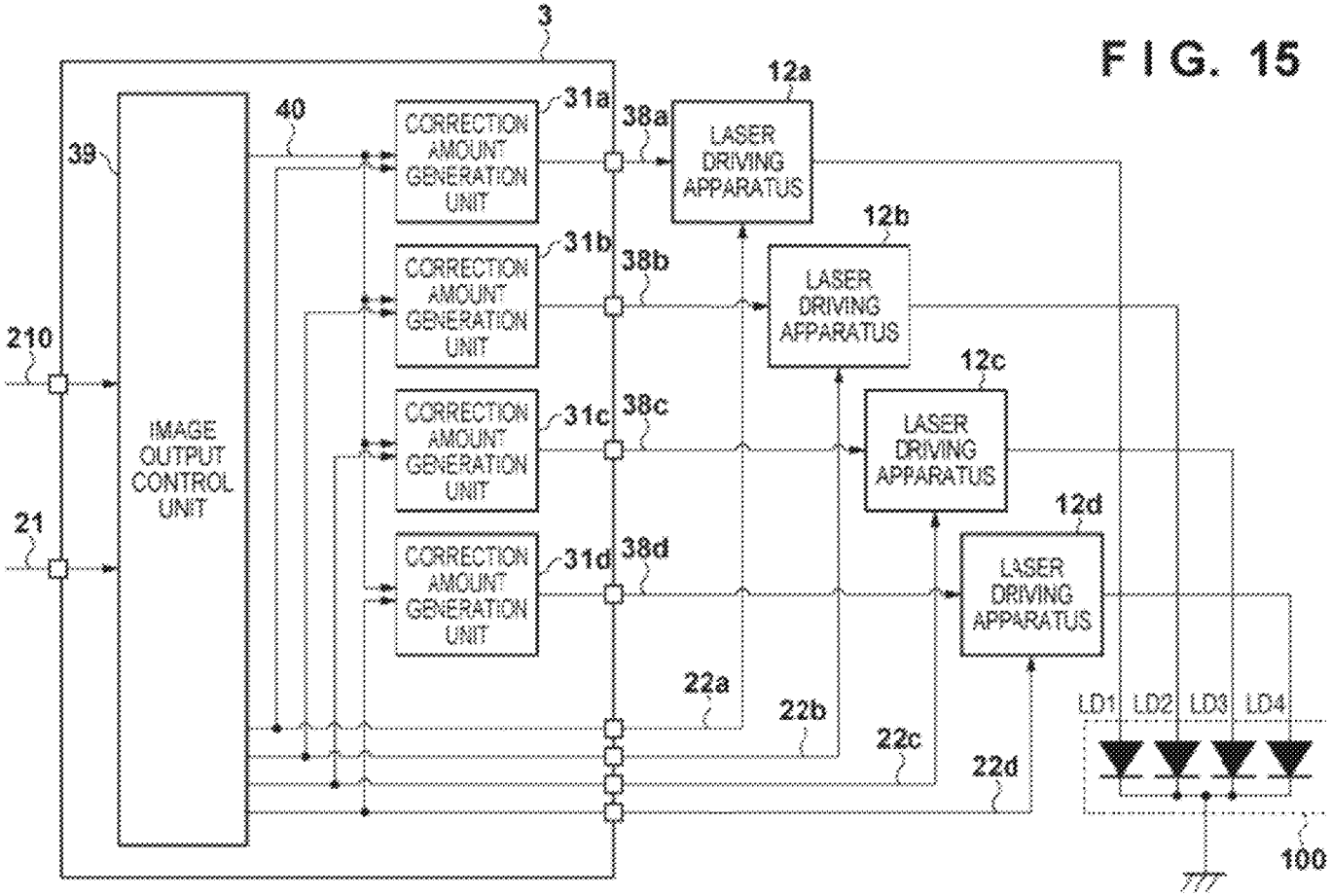
FIG. 15 is a block diagram illustrating a correction amount generation unit according to a fourth embodiment.

FIG. 15 is a block diagram illustrating an image control apparatus. A multi-beam semiconductor laser 100 includes multiple semiconductor lasers LD1 through LD4 serving as multiple light-emitting units. The semiconductor laser LD1 is driven by a laser driving apparatus 12*a*. Likewise, LD2 is driven by a laser driving apparatus 12*b*, LD3 is driven by a laser driving apparatus 12*c*, and LD4 is driven by a laser driving apparatus 12*d*. The internal configurations and operations of the individual laser driving apparatuses are the same as those described in the first through third embodiments.

Figure 16:
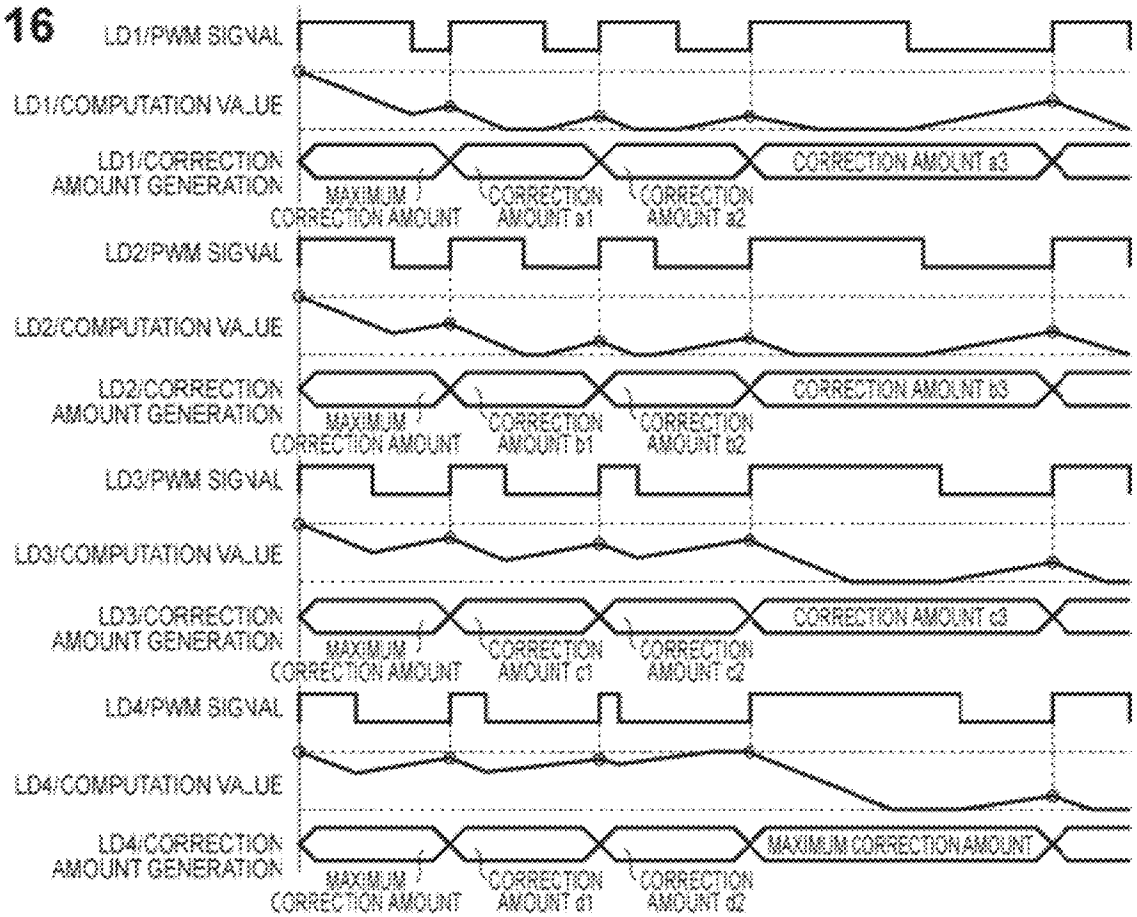
FIG. 16 is a timing chart illustrating operations performed by the correction amount generation unit according to the fourth embodiment.

Correction amount generation units 31*a* through 31*d* provided within an image control apparatus 3 supply correction amounts 38*a* through 38*d* to the laser driving apparatuses 12*a* through 12*d* that correspond respectively thereto. These elements operate in accordance with the timing chart illustrated in FIG. 16. The specific details thereof are the same as those described with reference to FIG. 8, and thus descriptions thereof will be omitted.

In this manner, the technical spirit of the present invention can also be applied in a multi-beam semiconductor laser. Because the characteristics of the respective semiconductor lasers provided in the multi-beam semiconductor laser differ, correcting the respective semiconductor lasers on an individual basis makes it possible to stabilize the shapes of dots.

Fifth Embodiment

A fifth embodiment is a variation on the fourth embodiment. Although each semiconductor laser includes a laser driving apparatus and a correction amount generation unit according to the fourth embodiment, the fifth embodiment employs a configuration that reduces the number of correction amount generation units. Specifically, the fifth embodiment is characteristic in that control circuits configured as groups including one each of a correction amount determination unit and a signal generation unit are provided on a one-to-N basis (where N is a natural number of 2 or more) for multiple light-emitting units, and each control circuit applies the same correction amount to the corresponding N light-emitting units. Here, descriptions will be given for a case where N is 2, but it should be clear that the present embodiment is also applicable in the case where N is 3 or more.

Figure 17:
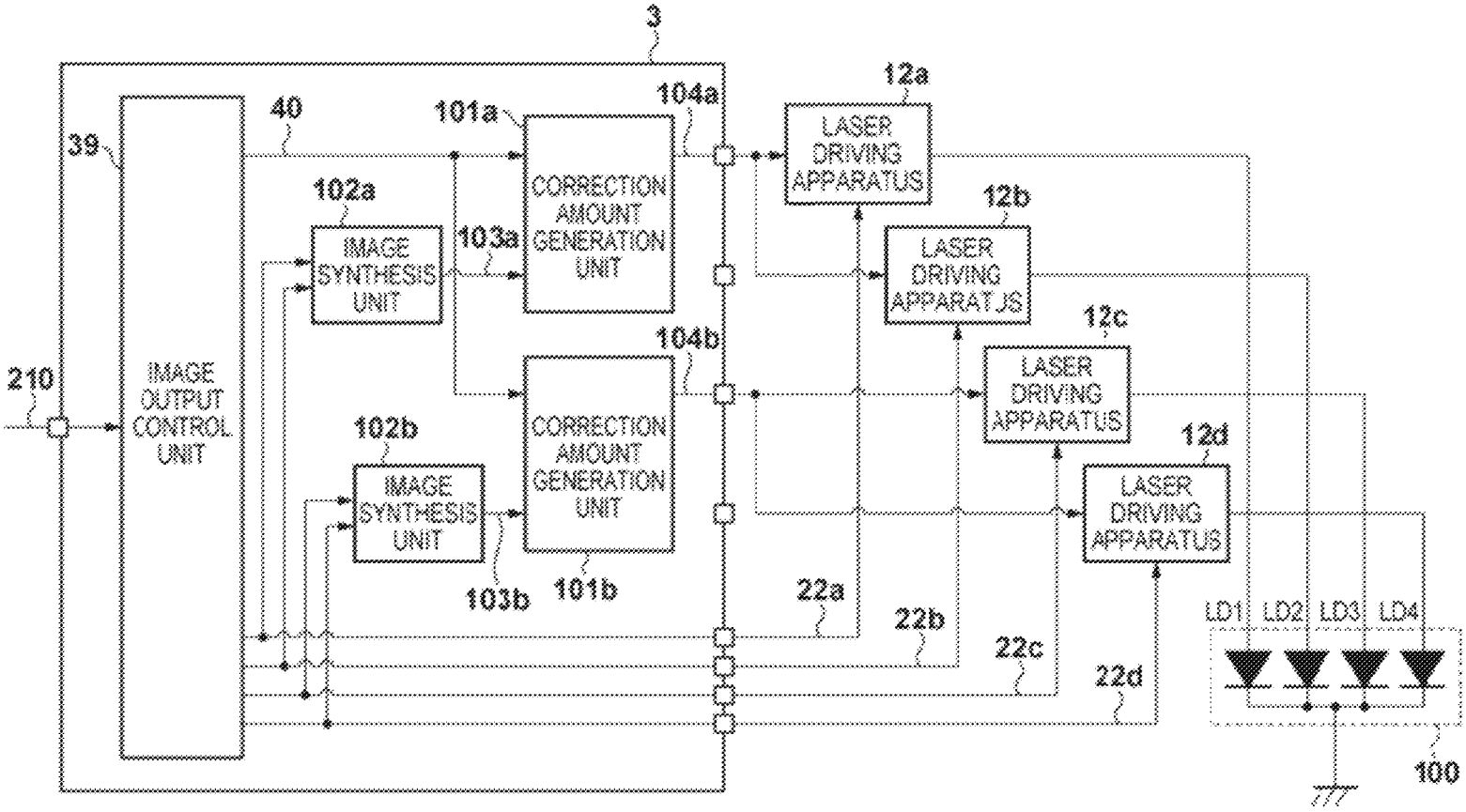
FIG. 17 is a block diagram illustrating a correction amount generation unit according to a fifth embodiment.
Figure 18:
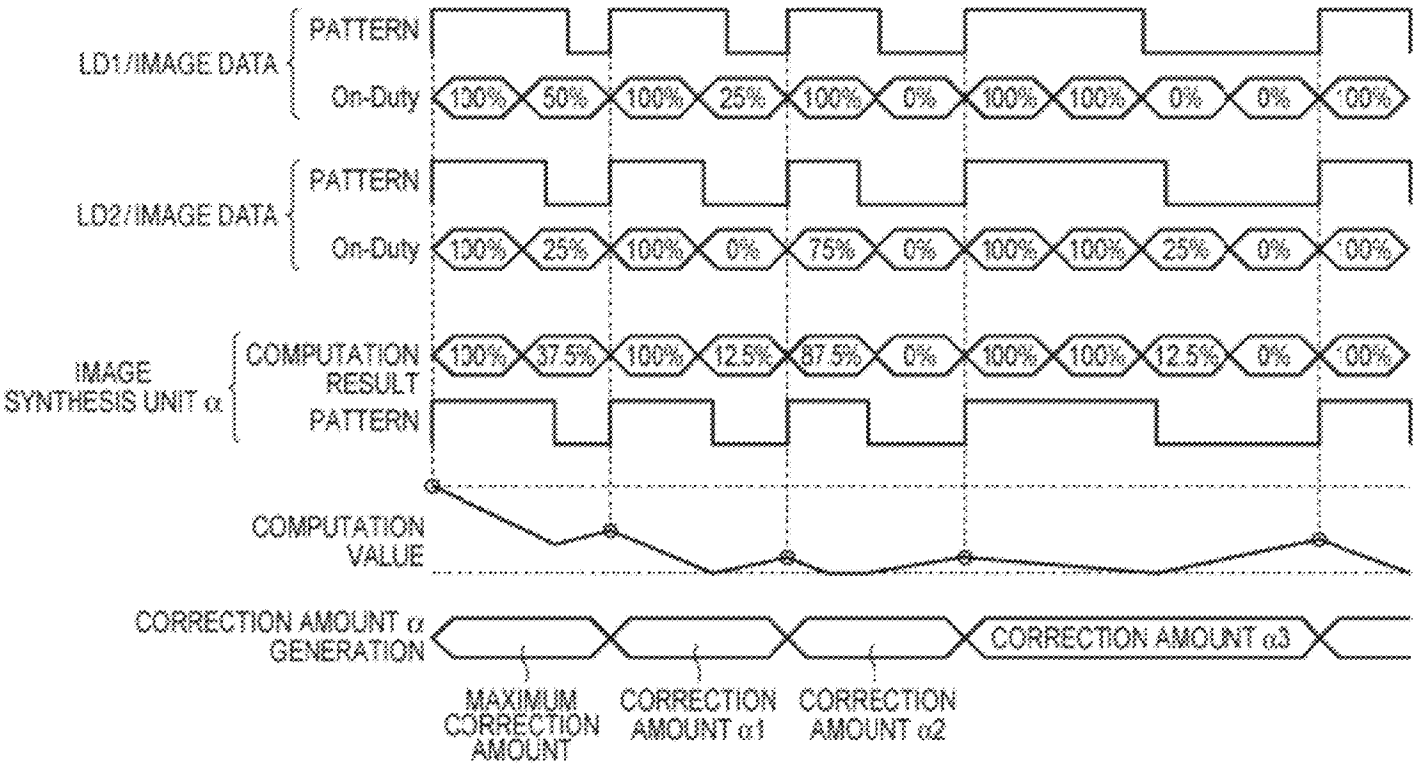
FIG. 18 is a timing chart illustrating operations performed by the correction amount generation unit according to the fifth embodiment.

FIG. 17 is a block diagram illustrating an image control apparatus. FIG. 18 is a timing chart for an image synthesis unit and a correction amount generation unit. A correction amount generation unit 101*a* is a unit that supplies a correction amount to laser driving apparatuses 12*a* and 12*b*. An image synthesis unit 102*a*, connected to the correction amount generation unit 101*a*, synthesizes a PWM signal 22*a* for a semiconductor laser LD1 with a PWM signal 22*b* for a semiconductor laser LD2, and outputs the resultant. The synthesis method may be, for example, a method that finds the average value of the PWM signal 22*a* and the PWM signal 22*b*. The correction amount generation unit 101*a* outputs a correction amount 104*a* through the methods described in the first through third embodiments in accordance with a PWM signal 103*a* resulting from the synthesis. An image synthesis unit 102*b*, connected to a correction amount generation unit 101*b*, combines a PWM signal 22*c* for a semiconductor laser LD3 and a PWM signal 22*d* for a semiconductor laser LD4, and outputs the resultant. The correction amount generation unit 101*b* outputs a correction amount 104*b* through the methods described in the first through third embodiments in accordance with a PWM signal 103*b* resulting from the synthesis.

According to the fifth embodiment, a simpler configuration than that described in the fourth embodiment can be employed. The fifth embodiment is considered useful in the case where the characteristics of the pair of semiconductor lasers LD1 and LD2 (or LD3 and LD4) are similar, the case where the patterns themselves of the PWM signals are similar, and so on. Note that with respect to the calculation of the correction amount, in the case where the second embodiment is employed, the correction amount may be calculated by measuring the light amounts of both of the semiconductor lasers that form a pair and using the average value thereof, using only the light amount of one of the semiconductor lasers, and so on. With respect to the calculation of the correction amount, in the case where the third embodiment is employed, the correction amount may be calculated by measuring the temperatures of both of the semiconductor lasers that form a pair and using the average value thereof, using only the temperature of one of the semiconductor lasers, and so on. Furthermore, the configuration illustrated in FIG. 17 may be simplified even more. Specifically, the image synthesis unit may be removed, and the correction amount may be determined for the N light-emitting units based on the duty ratio of a specific light-emitting unit from among the corresponding N light-emitting units. For example, the correction amount to be applied in common to the semiconductor lasers LD1 and LD2 that form a pair may be found based on one of the PWM signals 22*a* and 22*b*. In the case where the PWM signals 22*a* and 22*b* are similar, the circuit configuration can be reduced without causing a drop in the accuracy of the correction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2010-257300, filed Nov. 17, 2010 and 2011-236481, filed Oct. 27, 2011, which are hereby incorporated by reference herein in their entirety.

What is claimed is:

1. An image forming apparatus comprising:

a light source configured to turn on in response to a driving current supplied based on image data;

a photosensitive member on which an electrostatic latent image is formed by exposing the photosensitive member to a light beam output from the turned on light source;

a current supply unit configured to add a correction current to the driving current being supplied to the light source to correct a rise of a light amount of the light beam, wherein a peak value of the correction current is based on a driving state of the light source prior to the driving current, and the correction current reduces from its peak value as time advances; and a control unit, the control unit including a detection unit configured to detect a turn-on time and a turn-off time indicating the driving state of the light source based on the image data.

2. The image forming apparatus according to claim 1, wherein the control unit is further configured to control the peak value of the correction current so that the peak value of the correction current increases with an increase in the turn-off time of the light source prior to the supply of the driving current to the light source, and so that the peak value of the correction current decreases with an increase in the turn-on time of the light source prior to the supply of the driving current to the light source.

3. The image forming apparatus according to claim 2, further comprising:

a computation unit configured to compute a ratio between the turn-off time and the turn-on time, wherein the control unit is further configured to determine a correction amount based on the ratio, and to control the peak value of the correction current based on the correction amount.

4. The image forming apparatus according to claim 3, further comprising a limiting unit configured to limit the ratio or the correction amount to less than or equal to a predetermined upper limit value.

5. The image forming apparatus according to claim 4, wherein the limiting unit is further configured to set the ratio or the correction amount to the upper limit value before the start of input of the image data or a drive signal.

6. The image forming apparatus according to claim 3, further comprising a limiting unit configured to limit the ratio or the correction amount to greater than or equal to a predetermined lower limit value.

7. The image forming apparatus according to claim 3, further comprising:

an emitted light intensity detection unit configured to detect the emitted light intensity of the light beam, wherein the control unit is further configured to carry out variable control of the correction amount in accordance with the emitted light intensity of the light beam detected by the emitted light intensity detection unit.

8. The image forming apparatus according to claim 3, further comprising:

a temperature detection unit configured to detect a temperature within the image forming apparatus, wherein the control unit is further configured to carry out variable control of the correction amount in accordance with the temperature detected by the temperature detection unit.

9. The image forming apparatus according to claim 1, wherein the control unit further includes:

a holding unit configured to hold a predetermined relationship between at least one of the turn-on time and the turn-off time of the light source and a correction amount for correcting the intensity of the light beam; and a specifying unit configured to specify at least one of the turn-on time and the turn-off time of the light source corresponding to the image data, and wherein a correction amount corresponding to the at least one of the turn-on time and the turn-off time of the light source specified by the specifying unit is determined based on the relationship held in the holding unit.

10. The image forming apparatus according to claim 1, further comprising a control unit, the control unit including a detection unit configured to detect a turn-on time and a turn-off time indicating the driving state of the light source based on the image data.

11. The image forming apparatus according to claim 1, wherein the control unit further includes a capacitor and is configured to control an electric charge to be charged in the capacitor based on both of the turn-on time and the turn-off time.

12. The image forming apparatus according to claim 11, wherein an upper limit of the electric charge to be charged in the capacitor is predetermined.

13. The image forming apparatus according to claim 12, wherein the control unit is further configured to set the upper limit to the electric charge to be charged in the capacitor upon supplying the driving current to turn on the light source after the turn-off time of the light source has continued over a predetermined time.

* * * * *